US009023565B2

(12) United States Patent
Hashimoto

(10) Patent No.: US 9,023,565 B2
(45) Date of Patent: May 5, 2015

(54) DEVELOPER, DEVELOPER CONTAINER, IMAGE FORMATION UNIT, AND IMAGE FORMATION APPARATUS

(71) Applicant: Oki Data Corporation, Tokyo (JP)

(72) Inventor: Yoshihiro Hashimoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 56 days.

(21) Appl. No.: 13/677,574

(22) Filed: Nov. 15, 2012

(65) Prior Publication Data

US 2013/0122411 A1 May 16, 2013

(30) Foreign Application Priority Data

Nov. 16, 2011 (JP) ..... 2011-250530

(51) Int. Cl.

| | |
|---|---|
| ***G03G 9/00*** | (2006.01) |
| ***G03G 9/087*** | (2006.01) |
| ***G03G 15/00*** | (2006.01) |
| ***G03G 9/16*** | (2006.01) |
| ***G03G 9/08*** | (2006.01) |
| ***G03G 9/09*** | (2006.01) |

(52) U.S. Cl.

CPC ..... *G03G 9/16* (2013.01); *G03G 9/0806* (2013.01); *G03G 9/08711* (2013.01); *G03G 9/08795* (2013.01); *G03G 9/08797* (2013.01); *G03G 9/0926* (2013.01)

(58) Field of Classification Search

CPC . G03G 9/00; G03G 9/08708; G03G 9/08711; G03G 15/0868

USPC ..... 430/105, 109.1, 108.22, 109.3, 123.53; 399/252

See application file for complete search history.

(56) References Cited

U.S. PATENT DOCUMENTS

| | | | | |
|---|---|---|---|---|
| 5,436,698 | A * | 7/1995 | Ohtaka | 399/113 |
| 6,114,077 | A * | 9/2000 | Voets et al. | 430/97 |
| 2004/0259012 | A1 * | 12/2004 | Fujikawa et al. | 430/109.2 |
| 2009/0162770 | A1 * | 6/2009 | Sako et al. | 430/105 |
| 2011/0256477 | A1 * | 10/2011 | Kaneko et al. | 430/108.4 |

FOREIGN PATENT DOCUMENTS

| | | | |
|---|---|---|---|
| JP | 2010-222085 | A | 10/2010 |

* cited by examiner

*Primary Examiner* — Thorl Chea

(74) *Attorney, Agent, or Firm* — Marvin A. Motsenbocker; Mots Law, PLLC

(57) ABSTRACT

A developer includes a toner containing at least a binder resin, wherein the toner has a molecular weight distribution Mz/Mw of 2.0 or smaller and a phase angle of viscoelasticity of 65° or greater.

6 Claims, 5 Drawing Sheets

FIG. 5

[Table 1]

| | Chain Transfer Agents | | Fluorescent Brightening Agent | Molecular Weight Distribution | | | | | Viscoelasticity (120°C) | | Gloss | Tint | Comprehensive Evaluation |
|---|---|---|---|---|---|---|---|---|---|---|---|---|---|
| | NOMP | MSD | | Mn | Mw | Mz | Mw/Mn | Mz/Mw | Viscosity [Pa·s] | Phase angle [°] | | | |
| First Embodiment | 0.5 wt% | 0.5 wt% | - | 10508 | 43874 | 89344 | 4.2 | 2.0 | 3650 | 65.0 | 87.3 | Slight yellow | B |
| Second Embodiment | ↑ | 0.8 wt% | 0.2 wt% | 8647 | 34469 | 62149 | 4.0 | 1.8 | 983 | 77.9 | 94.3 | Same color as paper | A |
| Third Embodiment | ↑ | ↑ | 0.5 wt% | 8194 | 36945 | 68318 | 4.5 | 1.8 | 1570 | 78.6 | 91.7 | Slight blue | A |
| Comparative Example 1 | - | - | - | 9636 | 57053 | 301951 | 5.9 | 5.3 | 3324 | 59.8 | 66.8 | Slight yellow | D |
| Comparative Example 2 | 0.5 wt% | 0.8 wt% | 0.8 wt% | 6487 | 34302 | 63346 | 5.3 | 1.8 | 1645 | 79.5 | 81.9 | Strong blue | D |

DEVELOPER, DEVELOPER CONTAINER, IMAGE FORMATION UNIT, AND IMAGE FORMATION APPARATUS

CROSS REFERENCE TO RELATED APPLICATIONS

This application claims priority based on 35 USC 119 from prior Japanese Patent Application No. 2011-250530 filed on Nov. 16, 2011, entitled "DEVELOPER, DEVELOPER CONTAINER, IMAGE FORMATION UNIT, AND IMAGE FORMATION APPARATUS", the entire contents of which are incorporated herein by reference.

BACKGROUND OF THE INVENTION

1. Field of the Invention

This disclosure relates to a developer used in an image formation apparatus, a developer container to contain the developer, an image formation unit including the developer container, and an image formation apparatus including the image formation unit.

2. Description of Related Art

In the case of a conventional image formation apparatus, when obtaining an image with high glossiness, fixation has been conducted in the following steps. First, a normal toner image (colored developer image) is transferred onto a surface of a medium by an image formation unit. After that, the medium is conveyed through a fixation device to fix the image onto the surface of the medium. Next, the medium is conveyed back to the image formation unit and the image formation unit transfers transparent toner (transparent developer) onto the surface of the medium where the image is fixed. Then, the medium is conveyed through the fixation device again for fixing the transparent toner on the medium (for example, Patent Document 1: Japanese Patent Application Publication No. 2010-222085).

SUMMARY OF THE INVENTION

However, an effort to obtain an image with high glossiness leads to a reduction in throughput.

An aspect of the invention is a developer including a toner containing at least a binder resin. The toner has a molecular weight distribution Mz/Mw of 2.0 or smaller and a phase angle of viscoelasticity of 65° or greater.

According to the aspect, an image with high glossiness can be obtained while preventing reduction in throughput.

BRIEF DESCRIPTION OF THE DRAWINGS

FIG. 5 is a table showing the evaluation results of clear toners according to the first to third embodiments as well as Comparative Examples 1 and 2.

DETAILED DESCRIPTION OF EMBODIMENTS

Figure 1:
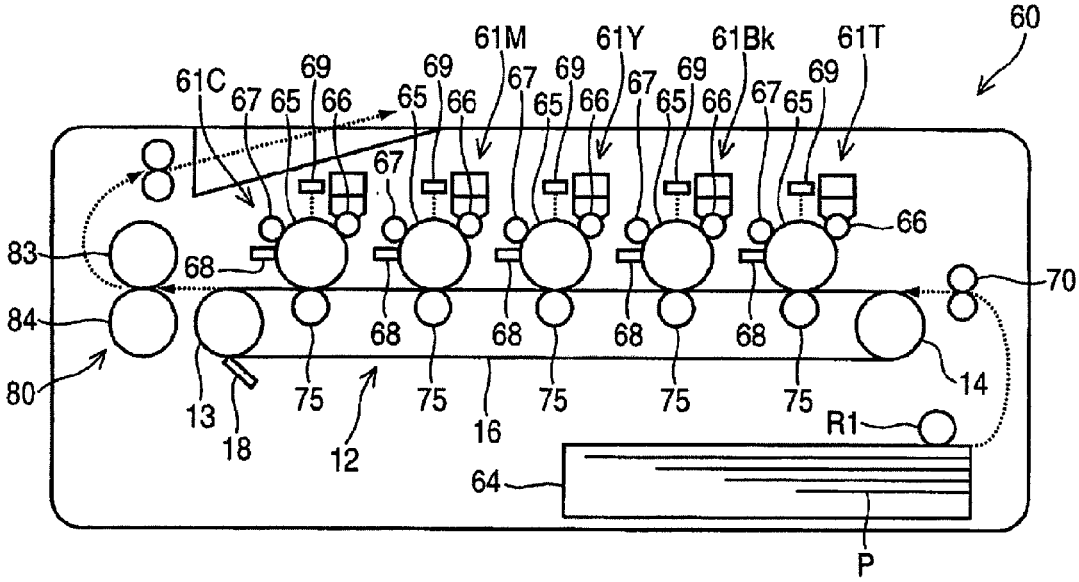
FIG. 1 is a side view schematically showing an internal configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Hereinbelow, the descriptions are made based on examples of a developer, a developer container, an image formation unit, and an image formation apparatus with reference to the drawings.

First Embodiment

FIG. 1 is a side view schematically showing an internal configuration of an image formation apparatus. As shown in FIG. 1, printer 60 includes image formation units 61T, 61Bk, 61Y, 61M, 61C, and belt-type transfer unit 12. Image formation units 61T, 61Bk, 61Y, 61M, 61C form a clear toner image as a transparent developer image and toner images as developer images of colors such as black (Bk), yellow (Y), magenta (M), cyan (C) depending on image data. Belt-type transfer unit 12 is placed to face photosensitive drums 65 as image carriers of image formation units 61T, 61Bk, 61Y, 61M, 61C while forming transfer regions for the respective colors between itself and photosensitive drums 65. Belt-type transfer unit 12 transfers, in a sequentially overprinting manner, the toner images of the colors formed on respective photosensitive drums 65 onto sheet P as a medium to form a color toner image.

In addition, printer 60 includes LED heads 69, paper feed cassette 64, registration rollers 70, fixation unit 80, and the like. LED heads 69 are respectively placed to face photosensitive drums 65 of image formation units 61T, 61Bk, 61Y, 61M, 61C, and serve as exposure devices which expose the surfaces of photosensitive drums 65 to form electrostatic latent images. Paper feed cassette 64 serves as a medium storage unit which stores sheets P as print media. Registration rollers 70 serve as a conveyance member which supplies sheet P to the transfer regions in line with the respective timings of image formation at image formation units 61T, 61Bk, 61Y, 61M, 61C, with sheet P being fed out from paper feed cassette 64 by paper feed roller R1 as a paper feed member. Fixation unit 80 serves as a fixation device which fixes the transparent toner image and the color toner images to sheet P after those images are transferred to sheet P at the transfer regions. Fixation device 80 includes heater roller 83 as a first rotation body and pressure roller 84 as a second rotation body. Note that in printer 60, image formation unit 61T is placed upstream of image formation units 61Bk, 61Y, 61M, 61C in a conveyance direction (movement direction) of sheet P.

Image formation units 61T, 61Bk, 61Y, 61M, 61C have the same structure and each image information unit includes photosensitive drum 65 which is rotatably provided. Each image information unit also includes charger roller 67, a development device (for example, development roller 66 as a developer carrier and supply roller 106 as a developer supply body), cleaning blade 68, and the like which are placed in this order in a rotation direction of photosensitive drum 65. Charger roller 67 serves as a charger device which uniformly charges the surface of each photosensitive drum 65. The development develops the electrostatic latent image formed by LED head 69 to form the toner image. Cleaning blade 68 serves as a first cleaning member included in a cleaning device.

Transfer unit 12 as a transfer device includes drive roller 13, idle roller 14, endless belt 16, transfer rollers 75, and cleaning blade 18. Drive roller 13 is connected to an unillustrated motor as a drive unit for transfer, and serves as a first roller which rotates in response to the rotation of the motor.

Idle roller 14 serves as a second roller which rotates by being driven by the rotation of drove roller 13. Endless belt 16 is stretched between drive roller 13 and idle roller 14 and made to travel, and serves as a transfer belt. Each of transfer rollers 75 is rotatably placed inside endless belt 16 in such a manner as to face photosensitive drum 65, and serves as a transfer member. Cleaning blade 18 is placed in contact with an outer peripheral surface of endless belt 16 in the vicinity of drive roller 13, and serves as a second cleaning member.

Figure 2:
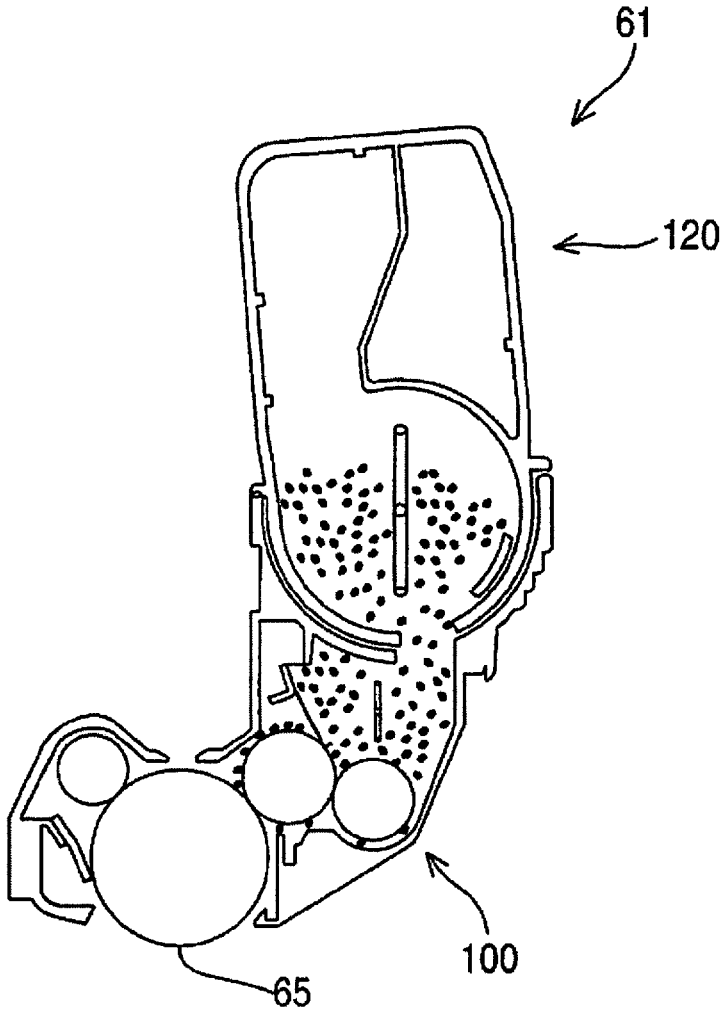
FIG. 2 is a side view schematically showing an internal configuration of an image formation unit.
Figure 3:
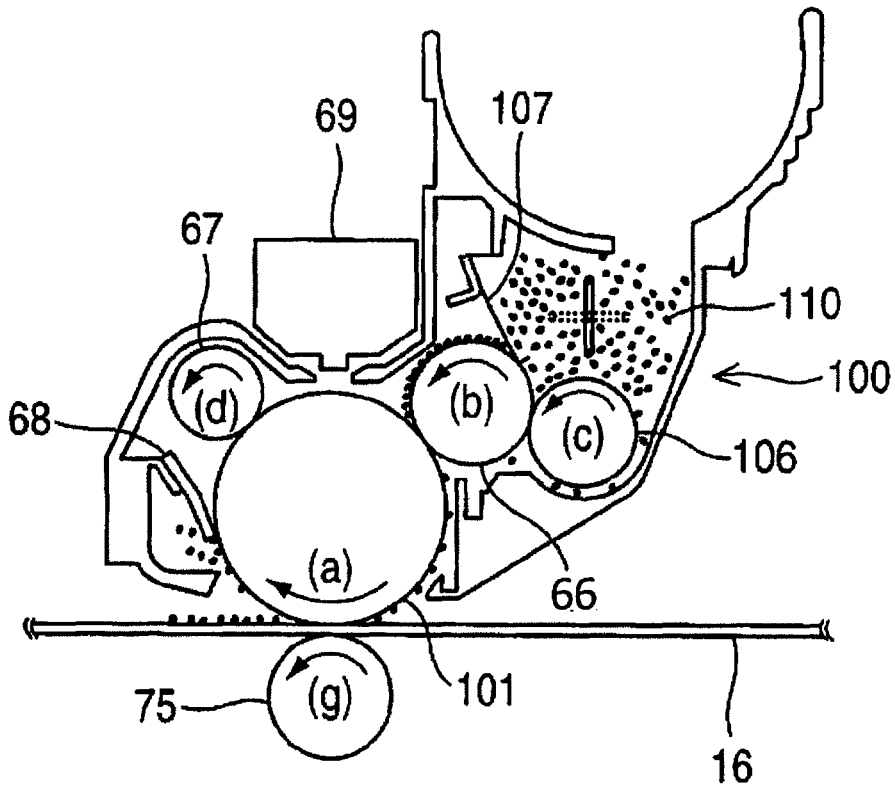
FIG. 3 is a side view schematically showing an internal configuration of a development part in the image formation unit.
Figure 4:
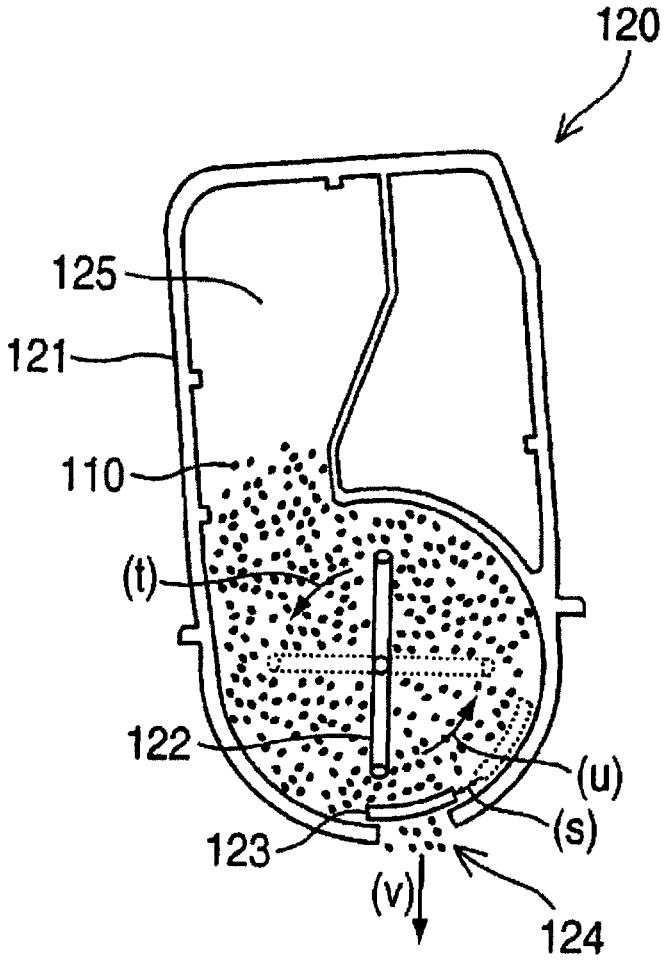
FIG. 4 is a side view schematically showing an internal configuration of a developer container in the image formation unit.

Description is made in detail on the structures of image formation units 61T, 61Bk, 61Y, 61M, 61C with reference to FIGS. 2 to 4. As described above, image formation units 61T, 61Bk, 61Y, 61M, 61C have the same structure, and thus are described as image formation units 61.

FIG. 2 is a side view schematically showing an internal configuration of each of image formation units 61. FIG. 3 is a side view schematically showing a development part in image formation unit 61. FIG. 4 is a side view schematically showing an internal configuration of a developer container in image formation unit 61.

As shown in FIG. 2, image formation unit 61 includes development part 100 and toner cartridge 120 which is a developer container. Image formation unit 61 is attached to printer 60 in such a manner as to be detachable and attachable. Toner cartridge 120 is attached to development part 100 in such a manner as to be detachable and attachable.

As shown in FIGS. 2 and 3, photosensitive drum 65 includes a conductive support body and photoconductor layers. Photosensitive drum 65 is an organic photoreceptor having a structure where a charge generation layer and a charge transport layer as photoconductor layers are sequentially stacked on an aluminum metal pipe as a conductive support body. Charger roller is provided in contact with a peripheral surface of photosensitive drum 65, and includes a metal shaft and a semiconductive epichlorohydrin rubber layer. LED head 69 has, for example, LED elements and a lens array, and is placed at a position to allow light emitted from the LED elements to form an image onto the surface of photosensitive drum 65.

Development roller 66 as a developer carrier is provided in contact with the peripheral surface of photosensitive drum 65, and includes a metal shaft and a semiconductive polyurethane rubber layer. Supply roller 106 as a developer supply body, which is in sliding contact with development roller 66, includes a metal shaft and a semiconductive foamed silicone sponge layer. Each of toners 110 of Bk, Y, M, and C uses a polyester resin as a binder resin, and includes a charge control agent, a release agent, and a colorant as internal additives, and silica microparticles as an external additive. Development blade 107, as a developer regulating member, is in pressure contact with the surface of development roller 66 and is made of stainless steel. Cleaning blade 68, as a developer collection device, is in pressure contact with the peripheral surface of photosensitive drum 65 and is made of polyurethane rubber.

Photosensitive drum 65 is rotated by an unillustrated drive unit in the arrow (a) direction at a constant circumferential speed. Charger roller 67 is provided in contact with the surface of photosensitive drum 65 and applies a DC voltage, supplied by an unillustrated high voltage power supply for the charger roller, to the surface of photosensitive drum 65 while being rotated in the arrow (d) direction, thereby charging the surface uniformly. Next, LED head 69 is provided to face photosensitive drum 65 and radiates light according to an image signal onto the uniformly charged surface of photosensitive drum 65. Then, the potential of the portion irradiated with light is optically attenuated to form an electrostatic latent image.

As shown in FIG. 4, agitator bar 122 extends in a longitudinal direction of toner storage 125 (the direction perpendicular to the sheet surface) and is rotatably supported at a given portion of toner storage 125 in container 121 of toner cartridge 120. Outlet 124 from which the toner in the container is discharged is formed below the agitator bar 122. Shutter 123 is placed inside the container in such a manner as to be slidable in the arrow (s) direction to open and close outlet 124.

After toner cartridge 120 is attached to development part 100, shutter 123 slides in the arrow (s) direction to open and close outlet 124 of container 121 in accordance with the operation of an unillustrated lever. This makes toner 110 in container 121 fall from outlet 124 in the arrow (v) direction, and toner 110 is thereby supplied to development part 100. As shown in FIG. 3, toner 110 fallen into development part 100 is supplied to development roller 66 by the rotation in the arrow (c) direction of supply roller 106 to which a voltage is applied by an unillustrated high voltage power supply for the supply roller.

Development roller 66 is placed in close contact with photosensitive drum 65, and a voltage is applied to development roller 66 by an unillustrated high voltage power supply for the development roller. Development roller 66 attracts toner 110 conveyed by supply roller 106 and conveys toner 110 by its rotation in the arrow (b) direction. In the course of the conveyance by the rotation, development blade 107, placed downstream of supply roller 106 and in pressure contact with development roller 66, forms a toner layer having a uniform thickness by leveling toner 110 attracted onto development roller 66.

Further, development roller 66 performs reversal development of the electrostatic latent image formed on photosensitive drum 65 in the following manner by using the toner carried by development roller 66. Since a bias voltage is applied between development roller 66 and the conductive support body of photosensitive drum 65 by the high voltage power supply, an electric line of force attributed to the electrostatic latent image formed on photosensitive drum 65 emerges between development roller 66 and photosensitive drum 65. Accordingly, charged toner 110 on development roller 66 adheres to the electrostatic latent image portion on photosensitive drum 65 by electrostatic force. Then the portion is developed to form a toner image. The above-described development process, which begins with initiation of the rotation of photosensitive drum 65, is started at a predetermined timing.

Next, a description is given of a transparent developer (hereinafter referred to as a clear toner) of the first embodiment. In the case of a clear toner which gives glossiness, it is necessary to lower the viscosity of the clear toner in a melting state by reducing its molecular weight as much as possible using no cross-linking agent for smoothing the printed surface of the print sheet. In this case, a chain transfer agent is used to reduce the molecular weight. Here, a general mercaptan-based chain transfer agent does not have much effect of reducing a high-molecular-weight fraction on the right side of the peak of the molecular weight distribution, but does have a large effect of increasing a low-molecular-weight fraction on the left side of the peak. Hence, using too much general mercaptan-based chain transfer agent leads to a significant decrease in Tg, and thus to a deterioration of the toner preservability and occurrence of development blade filming.

In addition, both a styrene acrylic resin and a polyester resin used for the clear toner take on a yellow tint. Accordingly, mere reduction in the amount of pigments in the toners of Y (yellow), M (magenta), C (cyan), and Bk (black) containing usual pigments may not be able to avoid a yellowish outcome at a printed clear portion which is similar to the color of the resins mentioned above.

As a result of an intense study, it is found that the addition of 2,4-diphenyl-4-methyl-1-pentene as a chain transfer agent has an effect of reducing the high-molecular-weight side, which is the right side of the peak of the molecular weight distribution. Specifically, it is confirmed that using 2,4-diphenyl-4-methyl-1-pentene as the chain transfer agent does not increase the low-molecular-weight side unlike the general mercaptan-based chain transfer agent, and thus a decrease in Tg can be prevented and the toner preservability can be secured. Moreover, reducing the high-molecular-weight side of the clear toner lowers the viscosity of the toner fixed inside the printer, and thus the print surface is made smoother, enabling glossier printing.

For this reason, in the first to third embodiments, a phase angle (=arctan (loss elastic modulus/storage elastic modulus)) which is one of the viscoelastic properties is increased in addition to the viscosity of the toner in a melting state being reduced by reducing the high-molecular-weight fraction of the molecular weight distribution of the clear toner. This enables generation of the clear toner which achieves a high glossiness of the print surface.

As for the clear toner of the first embodiment, a continuous phase is produced in the following steps. First, 110 parts of sodium phosphate are mixed with 3350 parts of pure water, and are sufficiently dissolved in the water at a liquid temperature of 60° C. to form a sodium phosphate mixture. Next, an aqueous calcium chloride solution is obtained by dissolving 70 parts of calcium chloride in 440 parts of pure water and the calcium chloride solution is put in the sodium phosphate mixture to forma resultant mixture. Then, the resultant mixture is agitated at a high speed (for example at 4300 rpm) by an agitator (for example, NEO MIXER manufactured by PRIMIX Corporation) for 30 minutes while the liquid temperature is maintained at 60° C. to produce the continuous phase.

Meanwhile, 510 parts of styrene monomer, 70 parts of butyl acrylate, and 30 parts of paraffin wax (melting point of 68° C.) are mixed, and the mixture is sufficiently agitated (for example, at 1800 rpm) by an emulsifier/disperser (for example, HOMO DISPER manufactured by PRIMIX Corporation) for 50 minutes while the temperature is maintained at 55° C., so that the solid materials are dissolved, to form a first mixture. Next, a liquid mixture is obtained by dissolving 15 parts of dimethyl 2,2'-azobis in 40 parts of styrene monomer and the liquid mixture is put in the first mixture, to forma second resultant mixture. After that, in order to further reduce the high-molecular-weight fraction, 3 parts of 2,4-diphenyl-4-methyl-1-pentene (MSD) represented by "Chemical Formula 1" below as the chain transfer agent (molecular weight modifier) are dispersedly put in the second resultant mixture together with 3 parts of mercaptopropionic acid ester (NOMP), to forma third resultant mixture. Then, the third resultant mixture is sufficiently agitated (for example, at 1800 rpm) for five minutes to produce a dispersed phase.

[Chemical Formula 1]

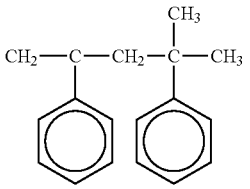

The dispersed phase thus produced is put in the continuous phase produced earlier to forma combined mixture, and the combined mixture is agitated (for example, at 3800 rpm) by the agitator at 60° C. to perform granulation. After the granulation, the combined mixture is agitated by an agitator at a low speed (for example, at 100 rpm) for 8 hours at 80° C. to perform polymerization, the agitator having special agitator blades (paddle blades) attached thereto. Further, calcium phosphate in the slurry is dissolved by using nitric acid and then the resultant mixture is dehydrated to form a cake.

Next, the cake is disintegrated by a disintegrator until the proper particle size of several millimeters is obtained. After that, the obtained particles are dried and silica external additive is added to the particles to produce the clear toner. The molecular weight distribution of the clear toner is measured by a high-performance liquid chromatograph (for example, Prominens manufactured by SHIMADZU CORPORATION). The measurement results are shown below.

| | |
|---|---|
| Mn (number average molecular weight) | 10508 |
| Mw (weight average molecular weight) | 43874 |
| Mz (z-average molecular weight) | 89344 |
| Mw/Mn | 4.2 |
| Mz/Mw | 2.0 |

Measurement conditions of molecular weight distribution in this case are set as follows.

Columns: TSKgel GMHXL (inner diameter 7.8 mm, length 30 cm: Tosoh Corporation)×2

TSKgel G2500HXL (inner diameter 7.8 mm, length 30 cm: Tosoh Corporation)×1

Eluant: THF

Sample concentration: 1%

Flow rate: 1.0 ml/min

Column temperature: 40° C.

Sample injection volume: 200 μl

The ratio "Mz/Mw" is more important than the ratio "Mw/Mn" for the clear toner to obtain glossiness. The reason is that the toner on the print surface after the fixation needs to be smoother to obtain glossiness and the clear toner during the fixation needs to have lower viscosity to realize the smoother toner. To lower the viscosity of the clear toner during the fixation, the high-molecular-weight fraction needs to be reduced. In other words, the viscosity of the clear toner is determined depending on the size of Mz, which indicates the spread of the molecular weight distribution to the high-molecular-weight side relative to the weight average molecular weight (Mw), and the ratio "Mz/Mw" is therefore more important.

Moreover, the viscoelasticity of the toner is measured by a rheometer (for example, VAR-100AD manufactured by Rheologica Instruments). The measurement results show that the viscosity is 3650 Pa·s and the phase angle is 65.0° at 120° C. The measurement conditions of the viscoelasticity in this case are set as follows.

Toner amount: 0.5 g

Temperature sweep: 50° C. to 230° C./36 min

Space between the sampling stage and the shaft: 1 mm

Frequency: 1 Hz

Delay time: 1 s

Strain: $1\times10^{-3}$

Phase angle δ is calculated by the rheometer using loss elastic modulus G" and storage elastic modulus G'. In other words, phase angle δ=arctan G"/G' holds true. A substance having the phase angle of 0° means a 100 percent elastic body, and a substance having the phase angle of 90° means a 100 percent viscous body. The phase angle of 45° means that viscosity and elasticity are balanced. In other words, if the phase angle is larger than 45°, a toner is more viscous and flowable. If the phase angle is smaller than 45°, the toner is closer to a solid.

A predetermined print pattern is printed by printer (image formation apparatus) 60 using the toner, and the gloss value of the print surface is measured by a gloss meter (for example, GM-26D manufactured by Murakami Color Research Laboratory). The gloss value obtained by the measurement is 87.3, which indicates good glossiness. In addition, part of the print surface, to which only the clear toner is applied, i.e., no toners of colors of Y, M, C are applied, is checked for a tint and this part is found to take on a slight yellow tint.

As seen in the above experiment, in the first embodiment, by using 2,4-diphenyl-4-methyl-1-pentene as the chain transfer agent in the amount of 0.5 wt % with respect to the weight of the toner, the high-molecular-weight fraction of the molecular weight distribution is reduced, the viscosity of the toner in a melting state is lowered, and the phase angle is increased, thereby enabling production of the clear toner which achieves a high glossiness of the print surface. In other words, by setting the molecular weight distribution Mz/Mw to 2.0 and the phase angle being one of the viscoelastic properties to 65.0, the clear toner with a high glossiness can be produced.

Second Embodiment

A clear toner of a second embodiment is next described. In the second embodiment, a continuous phase is produced in the following steps. First, 110 parts of sodium phosphate are mixed with 3350 parts of pure water, and are sufficiently dissolved in the water at a liquid temperature of 60° C., to form a sodium phosphate mixture. Next, an aqueous calcium chloride solution is obtained by dissolving 70 parts of calcium chloride in 440 parts of pure water and the solution is put in the sodium phosphate mixture. Then, the resultant mixture is agitated in high speed (for example at 4300 rpm) by the agitator used in the first embodiment for 30 minutes while the liquid temperature is maintained at 60° C. to produce the continuous phase.

Meanwhile, a dispersed phase is produced in the following steps. Specifically, 510 parts of styrene monomer, 70 parts of butyl acrylate, 30 parts of paraffin wax (melting point of 68° C.), and 1 part of 5-t-butyl-benzoxazolyl represented by "Chemical Formula 2" below are mixed, and the mixture is sufficiently dispersed and agitated (for example, at 1800 rpm) by the emulsifier/disperser used in the first embodiment for 50 minutes while the temperature is maintained at 55° C., so that the solid materials are dissolved and a first dispersed phase mixture is obtained.

[Chemical Formula 2]

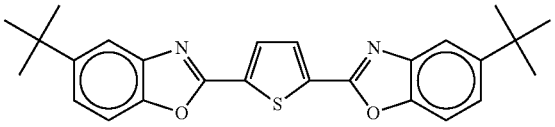

The substance 5-t-butyl-benzoxazolyl represented by "Chemical Formula 2" is a fluorescent brightening agent. Generally, the fluorescent brightening agent is used for accentuating whiteness of a dress shirt or improving transparency of a transparent film. However, it is considered that 5-t-butyl-benzoxazolyl, being contained in the toner, exerts an effect of reducing the yellow tint inherent to the resins.

After the dispersion and agitation of the dispersed phase mixture above, a liquid mixture obtained by dissolving 15 parts of dimethyl 2,2'-azobis in 40 parts of styrene monomer is put in the dispersed phase mixture. Next, in order to further reduce the high-molecular-weight fraction, 3 parts of 2,4-diphenyl-4-methyl-1-pentene (MSD) represented by "Chemical Formula 1" above as the chain transfer agent are dispersedly put in the dispersed phase mixture together with 3 parts of mercaptopropionic acid ester (NOMP), to forma resultant mixture. Then, the resultant mixture is sufficiently agitated (for example, at 1800 rpm) for five minutes to produce the dispersed phase.

The dispersed phase thus produced is put in the continuous phase produced earlier, and the mixture is agitated (for example, at 3800 rpm) by the above-mentioned agitator at 60° C. to perform granulation. After the granulation, the mixture is agitated by the agitator used in the first embodiment at a low speed (for example, at 100 rpm) for 8 hours at 80° C. to perform polymerization, the agitator having the special agitator blades. Further, calcium phosphate in the slurry is dissolved by using nitric acid, and then the resultant mixture is dehydrated to form a cake.

Next, the cake is disintegrated by the disintegrator used in the first embodiment until the proper particle size is obtained. After that, the obtained particles are dried and silica external additive is added to the particles to produce the clear toner. The molecular weight distribution of the clear toner of the second embodiment is measured by the high-performance liquid chromatograph used in the first embodiment under the same measurement conditions as in the first embodiment. The measurement results are shown below.

| | |
|---|---|
| Mn | 8647 |
| Mw | 34469 |
| Mz | 62149 |
| Mw/Mn | 4.0 |
| Mz/Mw | 1.8 |

Moreover, the viscoelasticity of the clear toner of the second embodiment is measured by the rheometer used in the first embodiment under the same conditions as in the first embodiment. The measurement results show that the viscosity is 983 Pa·s and the phase angle is 77.9° at 120° C. A predetermined print pattern is printed by an image formation apparatus (printer) using the clear toner of the second embodiment, and the gloss value of the print surface is measured. The gloss value obtained by the measurement is 94.3, which indicates very good glossiness. In addition, part of the print surface to which only the clear toner is applied, i.e., no toners of Y (yellow), M (magenta) or C (cyan) are applied, is checked for a tint and this part is found to take on no yellow tint and to have substantially the same color as the paper.

As seen in the above experiment, in the second embodiment, by using 2,4-diphenyl-4-methyl-1-pentene as the chain transfer agent in the amount of 0.8 wt % with respect to the weight of the toner, the high-molecular-weight fraction of the molecular weight distribution is reduced, the viscosity of the clear toner in a melting state is lowered, and the phase angle is increased, thereby enabling production of a clear toner which achieves high glossiness of the print surface. In other words, by setting the molecular weight distribution Mz/Mw to 1.8 and the phase angle being one of the viscoelastic properties to 77.9, the clear toner with a high glossiness can be produced. Further, by using 5-t-butyl-benzoxazolyl as the fluorescent brightening agent in the amount of 0.2 wt % with respect to the weight of the toner, the resin reduces its yellow tint and thus the clear toner achieving a high gloss quality of the print surface can be produced.

Third Embodiment

A clear toner of the third embodiment is next described. In the third embodiment, a continuous phase is produced in the following steps. First, 110 parts of sodium phosphate are mixed with 3350 parts of pure water, and are sufficiently dissolved in the water at a liquid temperature of 60° C., to form a sodium phosphate mixture. Next, an aqueous calcium chloride solution is obtained by dissolving 70 parts of calcium chloride in 440 parts of pure water and the resulting solution is put in the sodium phosphate mixture, to form a resulting mixture. Then, the resulting mixture is agitated at a highspeed (for example at 4300 rpm) by the agitator used in the first embodiment for 30 minutes while the liquid temperature is maintained at 60° C. to produce the continuous phase.

Meanwhile, a dispersed phase is produced in the following steps. Specifically, 510 parts of styrene monomer, 70 parts of butyl acrylate, 30 parts of paraffin wax (melting point of 68° C.), and 3 parts of 5-t-butyl-benzoxazolyl represented by "Chemical Formula 2" above are mixed, and the mixture as a first mixture is sufficiently dispersed and agitated (for example, at 1800 rpm) by the emulsifier/disperser used in the first embodiment for 50 minutes while the temperature is maintained at 55° C., so that the solid materials are dissolved. The substance 5-t-butyl-benzoxazolyl represented by "Chemical Formula 2" is the fluorescent brightening agent described in the second embodiment.

After the dispersion and agitation of the first mixture above, a liquid mixture is obtained by dissolving 15 parts of dimethyl 2,2'-azobis in 40 parts of styrene monomer and is put in the first mixture, to form a second mixture. Next, in order to further reduce the high-molecular-weight fraction, 5 parts of 2,4-diphenyl-4-methyl-1-pentene (MSD) represented by "Chemical Formula 1" above as the chain transfer agent are dispersedly put in the second mixture together with 3 parts of mercaptopropionic acid ester (NOMP). Then, the resultant mixture as a third mixture is sufficiently agitated (for example, at 1800 rpm) for five minutes to produce the dispersed phase.

The dispersed phase thus produced is put in the continuous phase produced earlier, and the mixture is agitated (for example, at 3800 rpm) by the above-mentioned agitator at 60° C. to perform granulation. After the granulation, the mixture is agitated by the agitator used in the first embodiment at a low speed (for example, at 100 rpm) for 8 hours at 80° C. to perform polymerization, with the agitator having the special agitator blades. Further, calcium phosphate in the slurry is dissolved by using nitric acid, and then the resultant mixture is dehydrated to form a cake.

Next, the cake is disintegrated by the disintegrator used in the first embodiment until the proper particle size is obtained. After that, the obtained particles are dried and silica external additive is added to the particles to produce the clear toner. The molecular weight distribution of the clear toner of the third embodiment is measured by the high-performance liquid chromatograph used in the first embodiment under the same measurement conditions as in the first embodiment. The measurement results are shown below.

| | |
|---|---|
| Mn | 8194 |
| Mw | 36945 |

-continued

| | |
|---|---|
| Mz | 68318 |
| Mw/Mn | 4.5 |
| Mz/Mw | 1.8 |

Moreover, the viscoelasticity of the clear toner of the third embodiment is measured by the rheometer used in the first embodiment under the same conditions as in the first embodiment. The measurement results show that the viscosity is 1570 Pa·s and the phase angle is 78.6° at 120° C. A predetermined print pattern is printed by an image formation apparatus (printer) using this toner, and the gloss value of the print surface is measured. The gloss value obtained by the measurement is 91.7, which indicates very good glossiness. In addition, part of the print surface, to which only the clear toner is applied, i.e., no colors of Y, M, C are applied, is checked for a tint and this part is found to take on a slight blue tint.

As seen in the above experiment, in the third embodiment, by using 2,4-diphenyl-4-methyl-1-pentene as the chain transfer agent in the amount of 0.8 wt % with respect to the weight of the toner, the high-molecular-weight fraction of the molecular weight distribution is reduced, the viscosity of the toner in a melting state is lowered, and the phase angle is increased, thereby enabling production of a clear toner which achieves high glossiness of the print surface. Further, by using 5-t-butyl-benzoxazolyl as the fluorescent brightening agent in the amount of 0.5 wt % with respect to the weight of the toner, the resin reduces its yellow tint and takes on a slight blue tint, and thus the clear toner achieving high gloss quality of the print surface can be produced. In other words, by setting the molecular weight distribution Mz/Mw to 1.8 and the phase angle being one of the viscoelastic properties to 78.6, the clear toner with high glossiness can be produced.

Next, Comparative Examples 1 and 2 are described.

Comparative Example 1

In Comparative Example 1, a clear toner is produced in the same manner as in the first embodiment except that neither mercaptopropionic acid ester (NOMP) nor 2,4-diphenyl-4-methyl-1-pentene (MSD) is used as a chain transfer agent (molecular weight modifier).

The molecular weight distribution of the produced clear toner is measured by the high-performance liquid chromatograph used in the embodiments above under the same measurement conditions as in the embodiments above. The measurement results are shown below.

| | |
|---|---|
| Mn | 10508 |
| Mw | 43874 |
| Mz | 89344 |
| Mw/Mn | 4.2 |
| Mz/Mw | 2.0 |

Moreover, the viscoelasticity of the clear toner of Comparative Example 1 is measured by the rheometer used in the embodiments above under the same conditions as in the embodiments above. The measurement results show that the viscosity is 3324 Pa·s and the phase angle is 59.8° at 120° C. A predetermined print pattern is printed by an image formation apparatus (printer) using the clear toner of Comparative Example 1, and the gloss value of the print surface is measured. The gloss value obtained by the measurement is 66.8, which shows no improvement in glossiness. Part of the print surface, to which only the clear toner is applied, i.e., no toners of Y, M, C are applied, is checked for a tint and this part is found to take on a slight yellow tint as in the first embodiment.

Comparative Example 2

In Comparative Example 2, a clear toner is produced in the same manner as in the second embodiment except that 5-t-butyl-benzoxazolyl is used as the fluorescent brightening agent in the amount of 0.8 wt % with respect to the weight of the toner.

The molecular weight distribution of the produced clear toner is measured by the high-performance liquid chromatograph used in the embodiments above under the same measurement conditions as in the embodiments above. The measurement results are shown below.

| | |
|---|---|
| Mn | 6487 |
| Mw | 34302 |
| Mz | 63346 |
| Mw/Mn | 5.3 |
| Mz/Mw | 1.8 |

Moreover, the viscoelasticity of the clear toner of Comparative Example 2 is measured by the rheometer used in the embodiments above under the same conditions as in the embodiments above. The measurement results show that the viscosity is 1645 Pa·s and the phase angle is 79.5° at 120° C.

A predetermined print pattern is printed by an image formation apparatus (printer) using the toner of Comparative Example 2, and the gloss value of the print surface is measured. The gloss value obtained by the measurement is 81.9, which indicates good glossiness. However, when part of the print surface, to which only the clear toner is applied, i.e., no toners of Y, M or C are applied, is checked for a tint, this part is found to take on a strong blue tint. This shows that the clear toner of Comparative Example 2 can be used for monochrome printing but is not suitable for color printing. Table 1 shown in FIG. 5 shows the evaluation results of the clear toners according to the first to third embodiments as well as Comparative Examples 1 and 2.

The toner is evaluated in the following manner. A toner having a measurement value with the gloss meter (gloss measurement value) smaller than 70 is evaluated as D. A toner having a gloss measurement value equal to or greater than 70 and smaller than 80 is evaluated as C. A toner having a gloss measurement value equal to or greater than 80 and smaller than 90 is evaluated as B. A toner having a gloss measurement value equal to or greater than 90 is evaluated as A. A tint of the clear toner is judged by human eyes. A toner judged as having a strong yellow tint or strong blue tint is evaluated as D. A toner judged as having a slight yellow tint is evaluated as B. A toner judged as having almost the same color as a paper with barely sensible tint or having a slight blue tint is evaluated as A. From the two viewpoints of the gloss and the tint, the glossiness of the print surface is comprehensively evaluated. The comprehensive evaluation result is determined in such a manner that the lower one out of the evaluation on the gloss measurement value and the evaluation on the tint is chosen. If the gloss value and the tint have the same evaluation, this evaluation result becomes the comprehensive evaluation result.

As shown in Table 1 (shown in FIG. 5), the clear toner of the first embodiment has a gloss measurement value of 87.3 and a tint of slight yellow, and thus has a comprehensive evaluation result of B. In other words, the result shows that the clear toner of the first embodiment is preferable as a clear toner. The toner of the second embodiment has a gloss measurement value of 94.3 and a tint which is the same as a white paper, and thus has a comprehensive evaluation result of A. In other words, the result shows that the toner of the second embodiment is more preferable as a clear toner. The toner of the third embodiment has a gloss measurement value of 91.7 and a tint of slight blue, and thus has a comprehensive evaluation result of A. In other words, the result shows that the toner of the third embodiment is more preferable as a clear toner like the second embodiment.

These results show that the clear toner with high glossiness can be achieved by setting the molecular weight distribution Mz/Mw to 2.0 or smaller and setting the phase angle of viscoelasticity to 65° or greater. In addition, it is preferable that the clear toner contains 2,4-diphenyl-4-methyl-1-pentene as the chain transfer agent in the amount of 0.5 wt % to 0.8 wt % with respect to the weight of the toner. Moreover, it is preferable that the clear toner contains 5-t-butyl-benzoxazolyl as the fluorescent brightening agent in the amount of 0.2 wt % to 0.5 wt % with respect to the weight of the toner.

In contrast, the clear toner of Comparative Example 1 has a gloss measurement value of 66.8 indicating unfavorable glossiness, and a tint of slight yellow. Thus, the clear toner has a comprehensive evaluation result of D. In other words, the result shows that the toner of Comparative Example 1 is not preferable as a clear toner.

The toner of Comparative Example 2 has a gloss measurement value of 81.9 indicating good glossiness. However, the clear toner of Comparative Example 2 per se has a tint of strong blue. In other words, the clear toner of Comparative Example 2 has poor colorlessness and transparency, and thus is not preferable as a clear toner. The clear toner of Comparative Example 2 has a comprehensive evaluation result of D.

High glossiness of the clear toner is obtained when printing is performed by using toner cartridge 120 as a developer container containing the clear toner (transparent developer) of any of the embodiments above, image formation unit 61T having toner cartridge 120, or printer 60 as an image formation apparatus including image formation unit 61T. Hence, an image with sufficient glossiness is obtained by transferring the clear toner image together with the colored (Bk, Y, M, C) toner images onto the medium and bringing the medium through fixation device 80 once.

Note that each of the developers in the first to third embodiments is a single-component developer containing a toner and no carrier. However, the developer may be a two-component developer containing a toner and a carrier, and the same good result can be obtained if the two-component developer contains a toner having the molecular weight distribution Mz/Mw of 2.0 or smaller and the phase angle of viscoelasticity of 65° or greater.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer comprising a toner containing at least a binder resin, wherein the toner has a molecular weight distribution Mz/Mw of 2.0 or smaller and a phase angle of viscoelasticity of 65° or greater, wherein the toner contains 5-t-butyl-benzoxazolyl in an amount of equal or more than 0.2 wt % and less than 0.5 wt % with respect to the weight of the toner, wherein the toner is a clear toner having substantially no colorant.

2. The developer according to claim 1, wherein the toner contains 2,4-diphenyl-4-methyl-1-pentene in an amount of 0.5 wt % to 0.8 wt % with respect to the weight of the toner.

3. The developer according to claim 1, wherein the binder resin is a styrene acrylic copolymer.

4. A developer container containing the developer of claim 1.

5. An image formation unit comprising:

the developer of claim 1;

an image carrier;

a charger device configured to charge a surface of the image carrier; and a development device configured to form a developer image on the surface of the image carrier by supplying the developer to an electrostatic latent image formed on the surface of the image carrier.

6. An image formation apparatus comprising:

the image formation unit of claim 5;

a transfer device configured to transfer the developer image onto a medium, the developer image formed by the image formation unit; and a fixation device configured to fix the transferred developer image onto the medium.

* * * * *